US012577863B2

(12) United States Patent
Shampine et al.

(10) Patent No.: US 12,577,863 B2
(45) Date of Patent: Mar. 17, 2026

(54) BREAKTHROUGH DETECTION FOR LITHIUM BEARING RESERVOIRS

(71) Applicant: Schlumberger Technology Corporation, Sugar Land, TX (US)

(72) Inventors: Rod William Shampine, Houston, TX (US); Roger A. Daar, Jr., Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/174,083

(22) Filed: Apr. 9, 2025

(65) Prior Publication Data

US 2025/0320796 A1 Oct. 16, 2025

Related U.S. Application Data

(60) Provisional application No. 63/632,762, filed on Apr. 11, 2024.

(51) Int. Cl.

| | |
|---|---|
| ***E21B 43/16*** | (2006.01) |
| ***E21B 43/14*** | (2006.01) |
| ***E21B 47/11*** | (2012.01) |

(52) U.S. Cl.

CPC ..... *E21B 43/162* (2013.01); *E21B 43/14* (2013.01); *E21B 47/11* (2020.05)

(58) Field of Classification Search

CPC ..... E21B 43/167; E21B 47/11; E21B 43/14

See application file for complete search history.

(56) References Cited

U.S. PATENT DOCUMENTS

| | | | | |
|---|---|---|---|---|
| 6,037,585 | A * | 3/2000 | Gadeken | E21B 47/006 250/262 |
| 11,732,326 | B1 * | 8/2023 | Duyvesteyn | C22B 26/12 423/179.5 |
| 2011/0303408 | A1 * | 12/2011 | Hartshorne | E21B 21/068 166/250.12 |
| 2017/0122077 | A1 * | 5/2017 | Shahri | G06F 30/20 |
| 2022/0055910 | A1 | 2/2022 | Jariwala | |
| 2023/0373803 | A1 * | 11/2023 | Perroni | C22B 3/22 |

FOREIGN PATENT DOCUMENTS

| | | | | |
|---|---|---|---|---|
| CN | 114876444 A | 8/2022 | | |
| WO | WO-2025109226 A1 * | 5/2025 | | E21B 49/08 |

* cited by examiner

*Primary Examiner* — Silvana C Runyan

(74) *Attorney, Agent, or Firm* — Kyle R. Miiller

(57) ABSTRACT

Aspects of the present disclosure provide a method for extracting minerals from a reservoir zone. The method includes extracting a fluid from the reservoir zone, the fluid including mineral brine and the mineral brine including the minerals, extracting the minerals from the mineral brine and producing a depleted effluent, injecting one or more tracers into the depleted effluent, injecting the depleted effluent with the one or more tracers into the reservoir zone, and monitoring the fluid for the one or more tracers.

19 Claims, 10 Drawing Sheets

BREAKTHROUGH DETECTION FOR LITHIUM BEARING RESERVOIRS

CROSS-REFERENCE TO RELATED APPLICATION

This application claims the benefit of U.S. Provisional Patent Application No. 63/632,762, filed Apr. 11, 2024, which is incorporated by reference herein in its entirety.

BACKGROUND

Field

Subsurface reservoirs, that may also be called "salars," have reservoir zones that contain a mineral brine with a desired mineral in said mineral brine. Direct Mineral Extraction (DME) may be used to extract minerals from these reservoir zones. These systems generally include a production well and a processing facility. The production well extracts the brine from the reservoir zone, the brine containing the desired mineral, and the processing facility extracts the mineral from the brine. The mineral may then be refined and sent off to be used in a variety of commercial applications.

While operating a DME system, it is important to manage the reservoir zone and the production process to maximize the production of the desired mineral from the extracted brine.

Description of the Related Art

Conventionally, the process for mineral mining comprises using evaporation pools. In this process, a mineral brine is extracted from a subsurface reservoir and the mineral brine is deposited in surface pools. Those surface pools permit the water components of the brine to evaporate leaving only the salts in the now dry pools. The salts may then be manually removed from the pools and transported for cleaning and refinement.

Another method for mineral extraction, Direct Mineral Extraction (DME), is explained more thoroughly and improved upon within this application. DME involves using a well to extract a mineral brine from a subsurface reservoir, also called a "salar," made up of one or more reservoir zones. The mineral brine is then processed at a processing facility using at least sorption. The output of the process is a liquid highly concentrated with the desired mineral. This output is sent off to be further processed to extract the desired mineral.

A byproduct of the operation is the portion of the brine which has now been depleted of the desired minerals. This portion may not be completely depleted of the desired mineral. There are varied processes for disposing of this mineral-depleted brine. Presently, this mineral-depleted brine is pumped down into a reservoir zone that may be the same or different from the producing reservoir zone. However, this may lead to undesirable extraction of the mineral-depleted brine, thus reducing the mineral output of the process.

Therefore, there is a need for management of reservoir zones and production in mineral extraction processes.

SUMMARY

Aspects of the present disclosure provide systems and methods for extracting minerals from subsurface mineral reservoirs.

Aspects of the present disclosure provide a method for extracting minerals from a reservoir zone. The method includes extracting fluid from the reservoir zone, the fluid including mineral brine and the mineral brine including the minerals, extracting the minerals from the mineral brine and producing a depleted effluent, injecting one or more tracers into the depleted effluent, injecting the depleted effluent with the one or more tracers into the reservoir zone, and monitoring the fluid extracted from the reservoir zone for the one or more tracers.

Aspects of the present disclosure provide a method for extracting minerals from one or more extraction reservoir zones. The method includes extracting fluid from the one or more extraction reservoir zones, the fluid including mineral brine and the mineral brine including the minerals, extracting the minerals from the mineral brine and producing a depleted effluent, injecting one or more tracers into the depleted effluent, injecting the depleted effluent with the one or more tracers into one or more injection reservoir zones, and monitoring the fluid extracted from the one or more extraction reservoir zones for the one or more tracers.

Aspects of the present disclosure provide a direct mineral extraction (DME) system. The DME system includes a DME plant, a tracer injection system, and a monitoring system. The DME plant configured to selectively extract a mineral from a fluid comprising mineral brine and output a depleted effluent. The tracer injection system configured to inject one or more tracers into the depleted effluent. The monitoring system configured to detect the one or more tracers in the fluid.

BRIEF DESCRIPTION OF DRAWINGS

The appended figures illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems and methods for extracting minerals from a reservoir zone.

Figure 1:
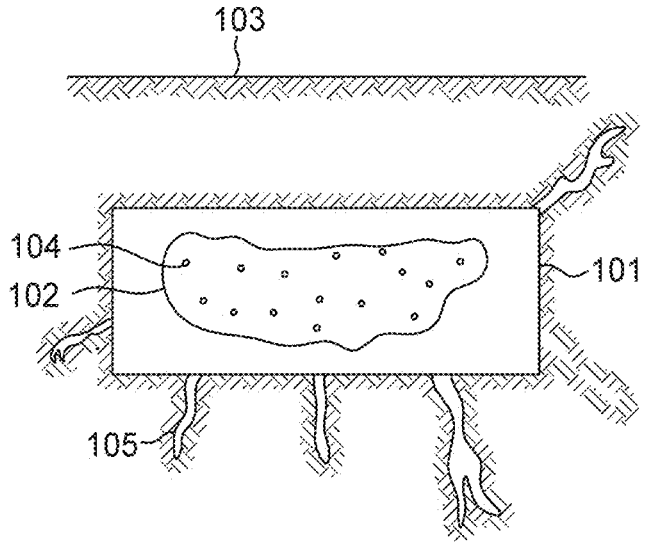
FIG. 1 illustrates a reservoir zone containing mineral brine, according to one or more embodiments of the present disclosure.

FIG. 1 illustrates a zone of a subsurface mineral reservoir (also called "salars"), hereinafter referred to as reservoir zones 101. While the reservoir zones 101 of FIG. 1, but also 107, 401, 402, 501 in other figures are shown herein as rectangular, the actual reservoir zones 101, 107, 401, 402, 501 have low or lower permeability boundaries and are likely to be complex in shape. These reservoir zones 101 contain mineral brines 102 and are below a surface 103. The mineral brines 102 contain, among other things, water and mineral product 104. The mineral product 104 may be Lithium or any other minerals that may be desirable to extract from the reservoir zones 101. These mineral products 104 are extracted through different processes.

These reservoir zones 101 may also contain fingers 105. These fingers 105 may be naturally created, purposefully created, or created as a byproduct of the extraction process such as through non-uniform flow. The fingers 105 are fissures that extend from reservoir zones 101 thus creating pathways stemming from the main body of the reservoir zone 101.

Figure 2:
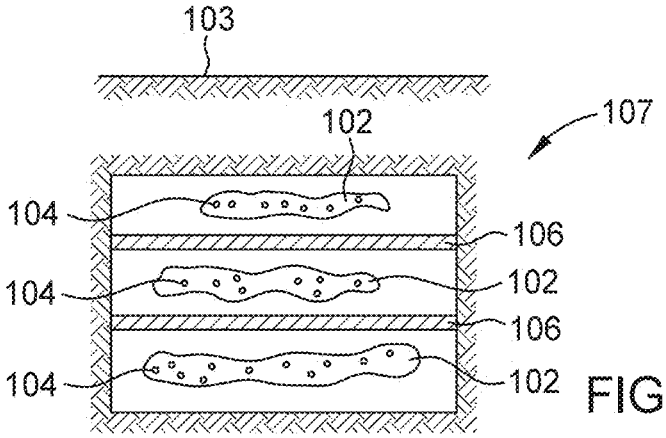
FIG. 2 illustrates another reservoir zone containing mineral brine, according to one or more embodiments of the present disclosure.

FIG. 2 illustrates multi-layered reservoir zones 107. In multi-layered reservoir zones 107 (rather than other reservoir zones, such as reservoir zone 101 of FIG. 1), there are layers of mineral brine 102 and layers of sediment or rock 106.

Figure 3:
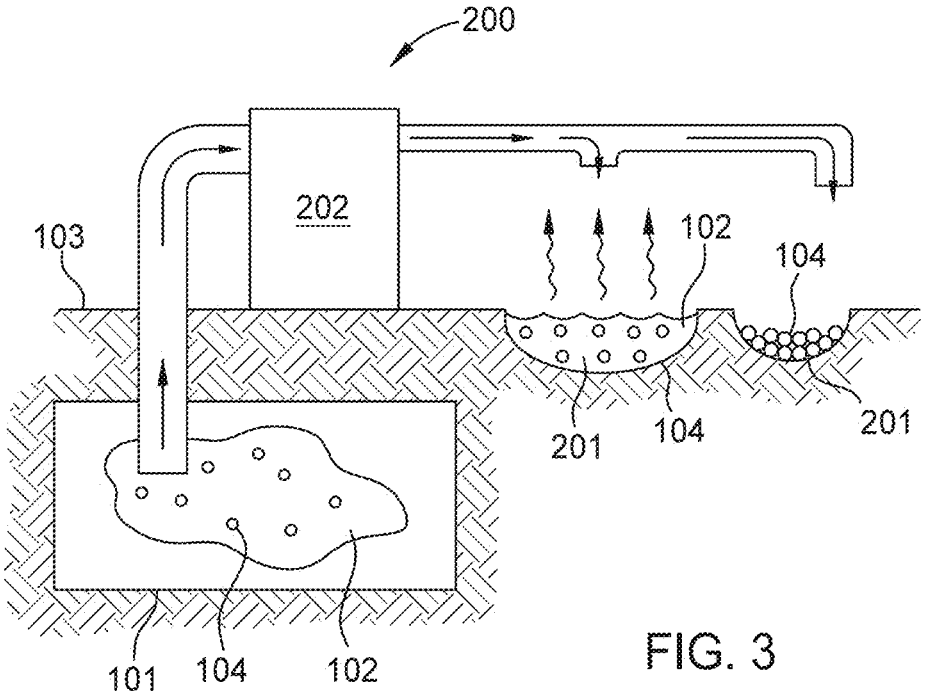
FIG. 3 illustrates a mineral extraction process utilizing evaporation ponds, according to one or more embodiments of the present disclosure.

In some embodiments, the minerals 104 are extracted utilizing evaporation ponds (such as evaporation pond 201 shown in FIG. 3) in an evaporation process 200. FIG. 3 illustrates a process utilizing evaporation ponds 201. A simplified version of the process 200 is as follows: extraction wells 301 extract the mineral brine 102 from reservoir zones 101, the brine 102 may be processed at a plant 202, and then the brine 102 is allowed to evaporate in the evaporation ponds 201 leaving the minerals 104 at the base of the ponds 201. The minerals 104 may then be sent off for processing.

In another embodiment, the minerals 104 are extracted by a Direct Mineral Extraction (DME) process.

Figure 4A:
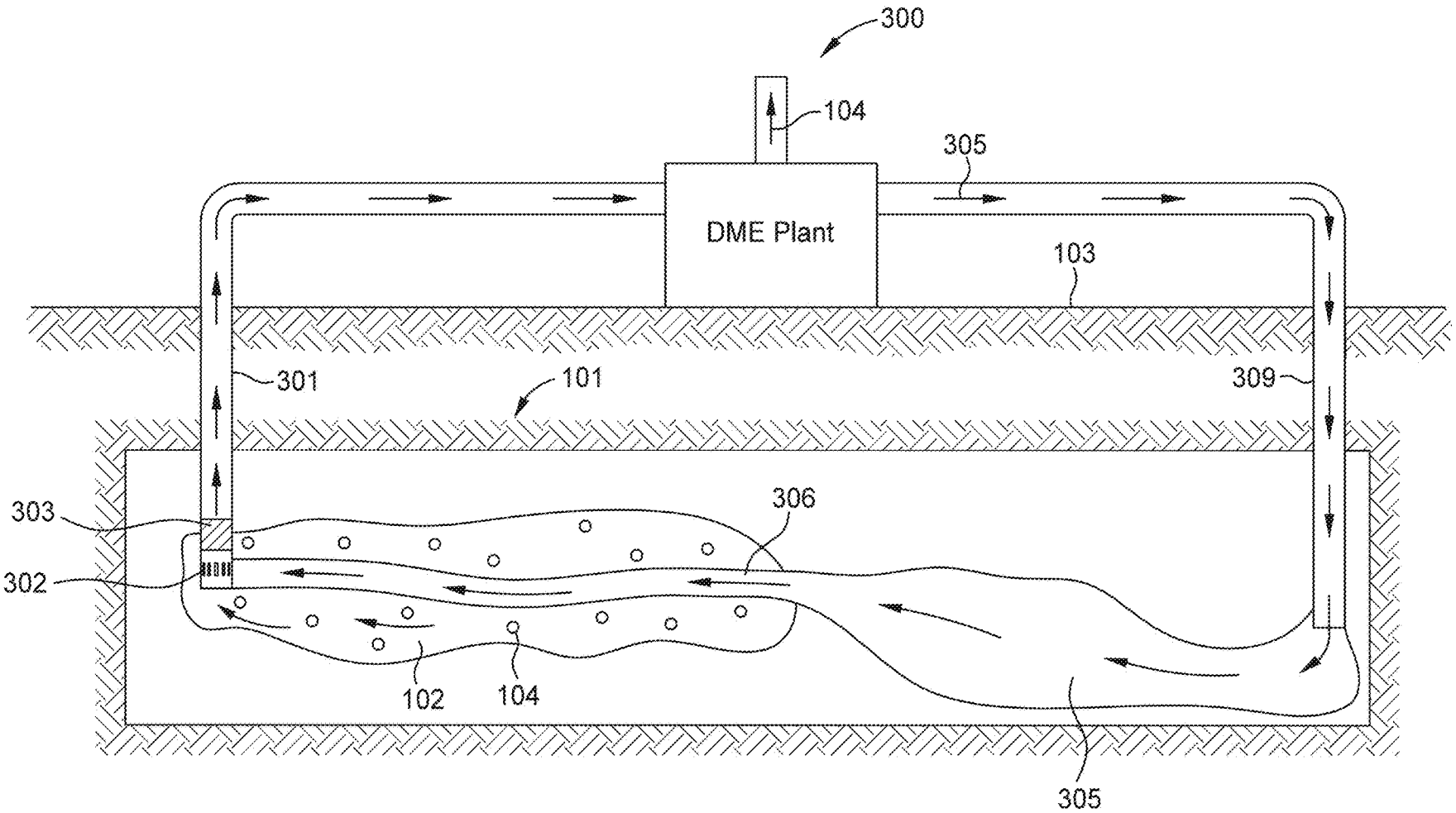
FIG. 4A illustrates a Direct Mineral Extraction (DME) process with a single reservoir zone, according to one or more embodiments.

FIG. 4A illustrates a DME process 300 utilizing a single reservoir zone 101. The DME process 300 includes using an extraction well 301 with perforations 302 and an electric submersible pump (ESP) 303 to extract mineral brine 102 from a reservoir zone 101. The mineral brine 102 is pumped to the surface 103 where it is pumped through a DME plant 304 which extracts the mineral product 104 via sorption.

Sorption involves pumping the mineral brine 102 into the DME plant 304. Within the plant 304, there is a sorption unit with a sorption medium that selectively adsorbs the desired mineral product 104 thereby isolating it from the remainder of the mineral brine 102. The remainder of the brine which has had the mineral product 104 removed from it becomes depleted effluent 305. The adsorbed minerals are recovered using a clean stream that is loaded with the minerals to form an eluent. The eluent may also be further processed into additional stages such as concentration and/or impurity removal. A description of an example sorption process may be seen in U.S. Publication No. US 2022/0055910 A1 which is incorporated by reference in its entirety herein.

The DME plant 304 effectively produces two products: the desirable mineral product 104, which is sent off for further processing and commercialization, and the depleted effluent 305, which is returned below surface 103 to the one or more reservoir zones 101 by one or more injection wells 309.

As previously indicated, depleted effluent 305 is the mineral brine 102 with a portion of the desirable mineral product 104 removed. The physical properties of the depleted effluent 305 and the mineral brine 102 are nearly indistinguishable other than the reduced amount of mineral product 104. Even so, the mineral brine 102 may include a concentration of 80-450 parts per million (ppm) of the mineral product 104 and the sorption process may be 50%-100% efficient. Accordingly, even the depleted effluent 305 still includes some mineral product 104, sometimes in the range of 0%-50% of the original concentration. While still containing mineral product 104, the depleted effluent 305 may not be commercially feasible to cycle through the process 300 due to the cost to run the process 300 and the reduced amount of extractable mineral product 104.

During the DME process 300 depleted effluent 305 may "breakthrough." Breakthrough occurs when the depleted effluent 305 is extracted through the extraction well 301 in addition to, or rather than, the desirable mineral brine 102 (e.g., the unprocessed brine 102). Breakthrough may cause the process 300 to no longer be commercially feasible, cost effective, or even possible. In some instances, the mineral product 104 extracted from the depleted effluent 305 may not be worth the cost or operation of the process 300. A non-limiting example of breakthrough is illustrated in FIG. 4A by pathway 306.

It is often difficult to track when breakthrough occurs because the mineral brine 102 is nearly indistinguishable from the depleted effluent 305 other than the reduced amount of desirable mineral product 104, and, as noted above, the concentration differences between the mineral brine 102 and the depleted effluent 305 may be very small (e.g., the depleted effluent 305 may have half the concentration of the mineral brine 102 and the mineral brines may have only had a concentration of 80 ppm.

Figure 4B:
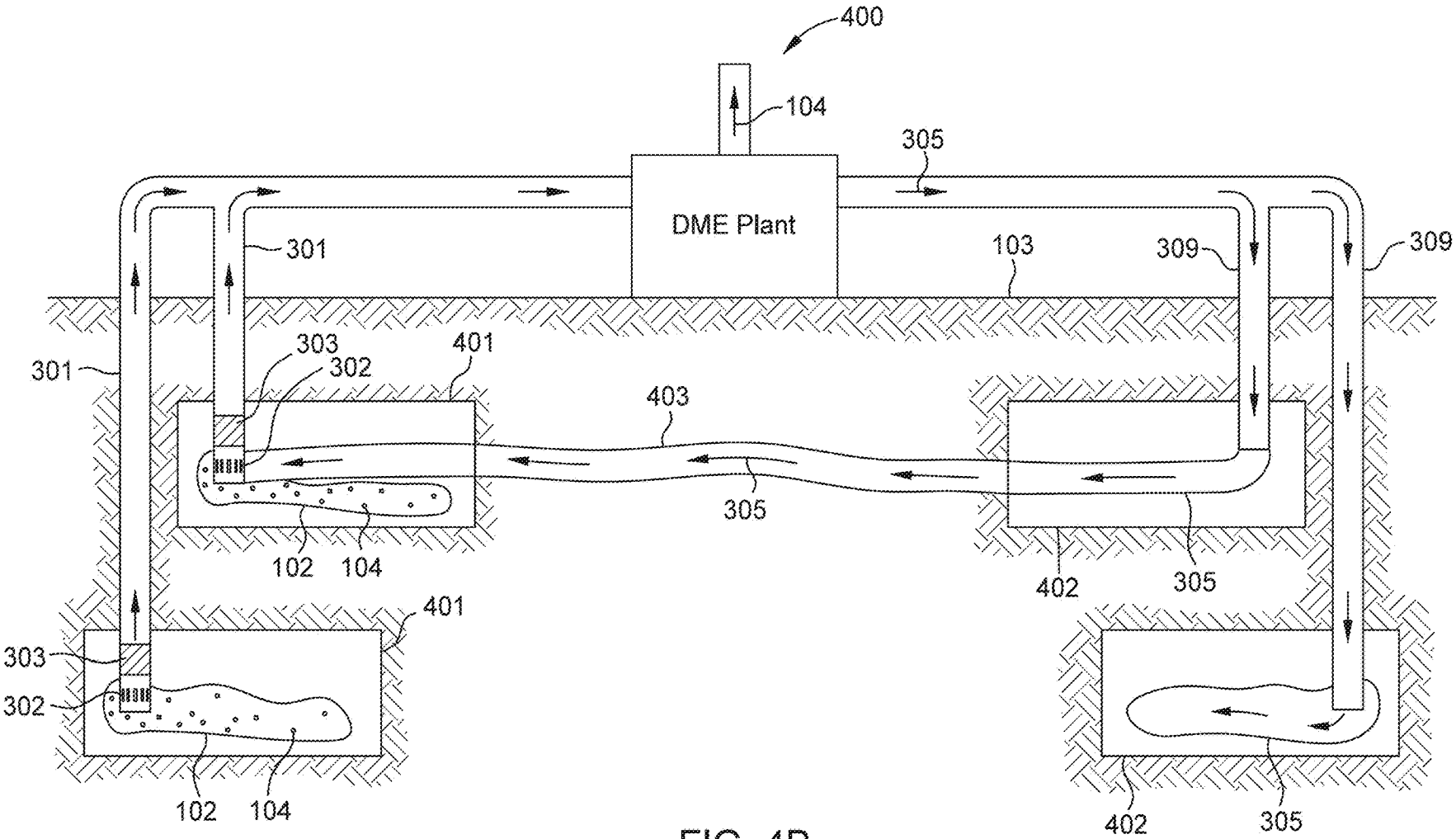
FIG. 4B illustrates another DME process with multiple reservoir zones, according to one or more embodiments

FIG. 4B illustrates another DME process 400 for extracting mineral brines 102 from multiple reservoir zones 101. In such embodiments, the DME process 400 includes at least one extraction reservoir zone 401 each with at least one of its own extraction wells 301 and at least one injection reservoir zone 402 each with at least one of its own injection wells 309. Otherwise, the process 400 of FIG. 4B is similar: extract mineral brine 102, extract the desired mineral product 104 via the DME plant 304, and inject the depleted effluent 305 below the surface 103. This process differs in where the mineral brine 102 is pumped from and where the depleted effluent 305 is pumped to. The use of multiple reservoir zones 401,402 may prevent the depleted effluent 305 from eventually being extracted through the one or more extraction wells 301. The process 400 also allows for better manipulation and modularity of the process 400 as one or more extraction wells 301 or one or more injection wells 309 can be stopped or plugged while still maintaining the process 400 as a whole.

However, like in the previously mentioned process 300, there exists a possibility that depleted effluent 305 may break through into one of the one or more extraction wells 301. When the depleted effluent 305 breaks through in process 400, it may be because the depleted effluent 305 has created or found a finger (such as finger 105 of FIG. 1) connecting one of injection reservoir zones 402 and one of the extraction reservoir zones 401. Breakthrough is illustrated in FIG. 4B by pathway 403. Again, breakthrough is difficult to track and, when it occurs, the process 400 may become no longer commercially feasible, cost effective or even possible.

Figure 4C:
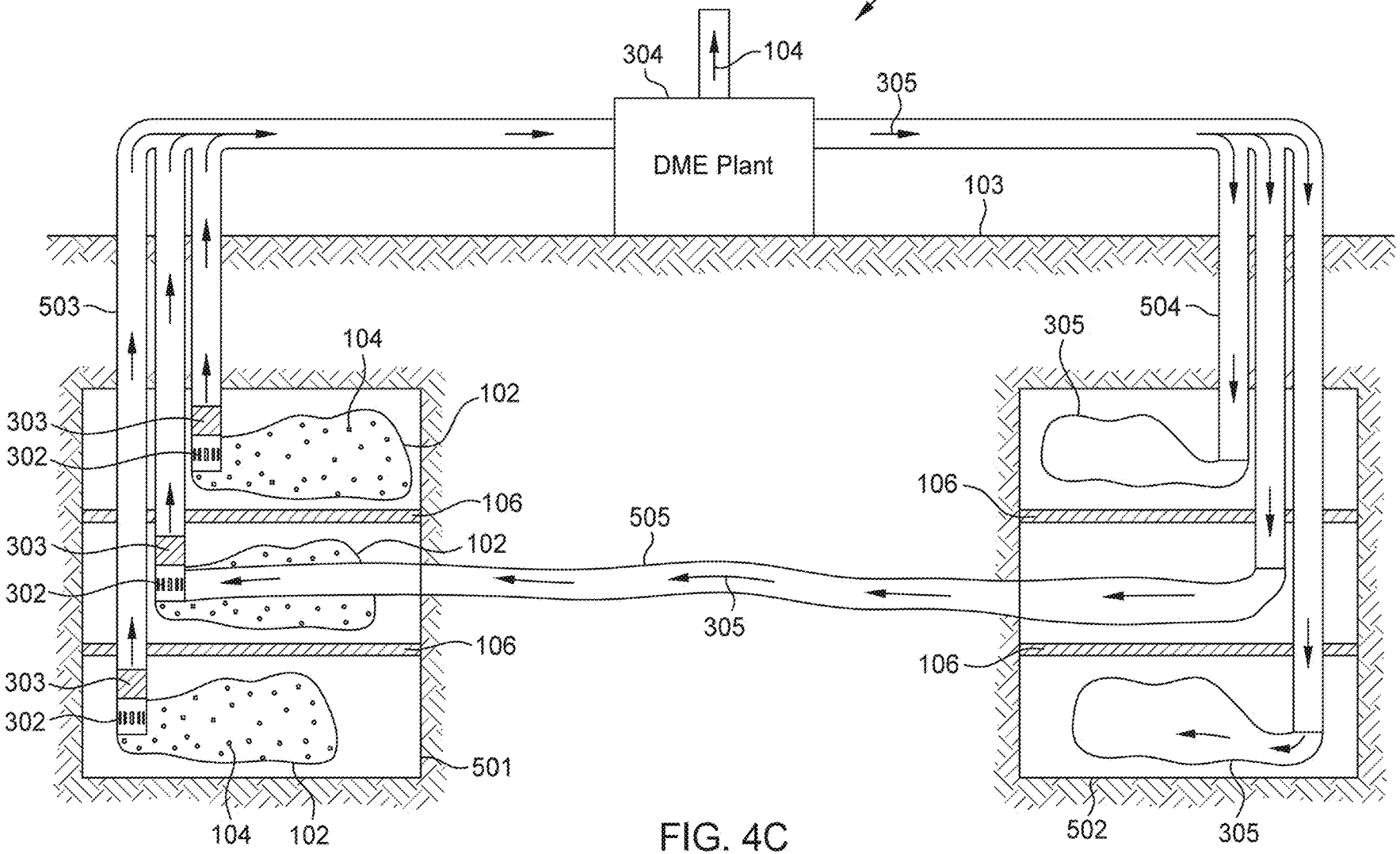
FIG. 4C illustrates another DME process with multiple extraction depths, according to one or more embodiments.
Figure 7:
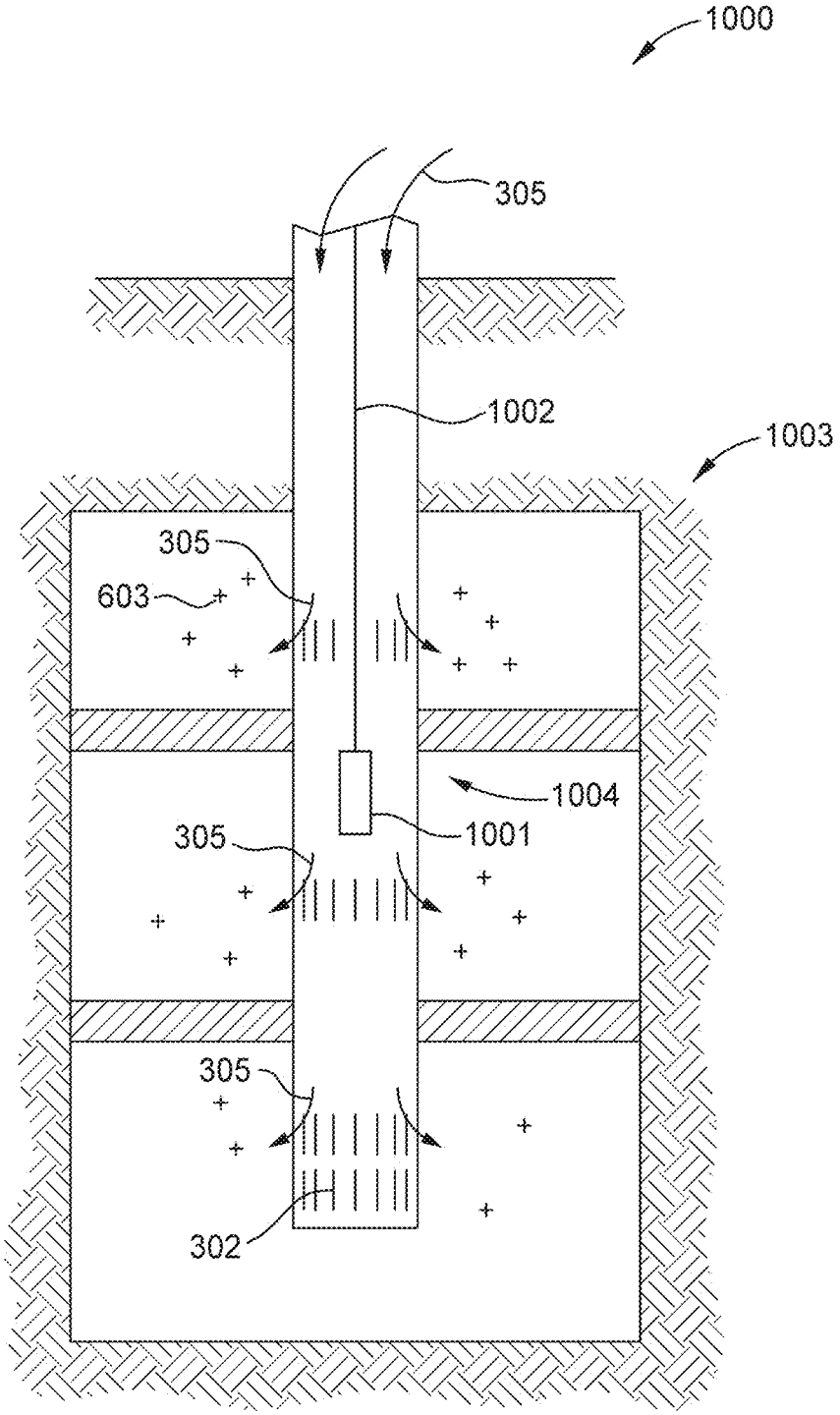
FIG. 7 partially illustrates another monitored DME process for in-situ monitoring, according to one or more embodiments.

FIG. 4C illustrates another DME process 500 for extracting mineral brines 102 from multi-layered extraction reservoir zones 501 and/or multi-layered injection reservoir zones 502. In such embodiments, the DME process 500 includes at least one multi-layered extraction reservoir zone 501 with at least one multi-depth extraction well 503 and at least one multi-layered injection reservoir zone 502 with at least one multi-depth injection well 504. The multi-depth extraction wells 503 and multi-depth injection wells 504 may have perforations 302 at varying depths corresponding to the layers of the reservoir zones 501,502. Although the multi-depth extraction wells 503 and multi-depth injection wells 504 are illustrated as having different flowpaths for each depth, it is understood that the differing depths may share a flowpath (e.g., different levels of perforations 302 are on one singular tubular extending through all of the layers of the reservoirs 501, 502 as illustrated in FIG. 7). Otherwise, the process 500 of FIG. 4B is similar: extract mineral brine 102, extract the desired mineral product 104 via sorption at the DME plant 304, and inject the depleted effluent 305 below the surface 103. This process differs in where the mineral brine 102 may be pumped from and where the depleted effluent 305 is pumped to.

However, like in the previously mentioned processes 300 and 400, there exists a possibility that depleted effluent 305 may break through into the one or more multi-depth extraction wells 503. When the depleted effluent 305 breaks through in process 500, it may be because the depleted effluent 305 has created or found a finger (such as finger 105 of FIG. 1) connecting the one or more multi-layered injection reservoir zones 502 and the one or more multi-layered extraction reservoir zones 501. Breakthrough is illustrated in FIG. 4C by pathway 505. Again, breakthrough is difficult to track and, when it occurs, the process 500 may become no longer commercially feasible, cost effective or even possible.

It is contemplated that the configurations of reservoir zones 101, 401, 402, 501, 502, extraction wells 301, 503, and injection wells 309, 504 of processes 300, 400, 500 may be combined in whole or in part in one or more DME processes.

Figure 5:
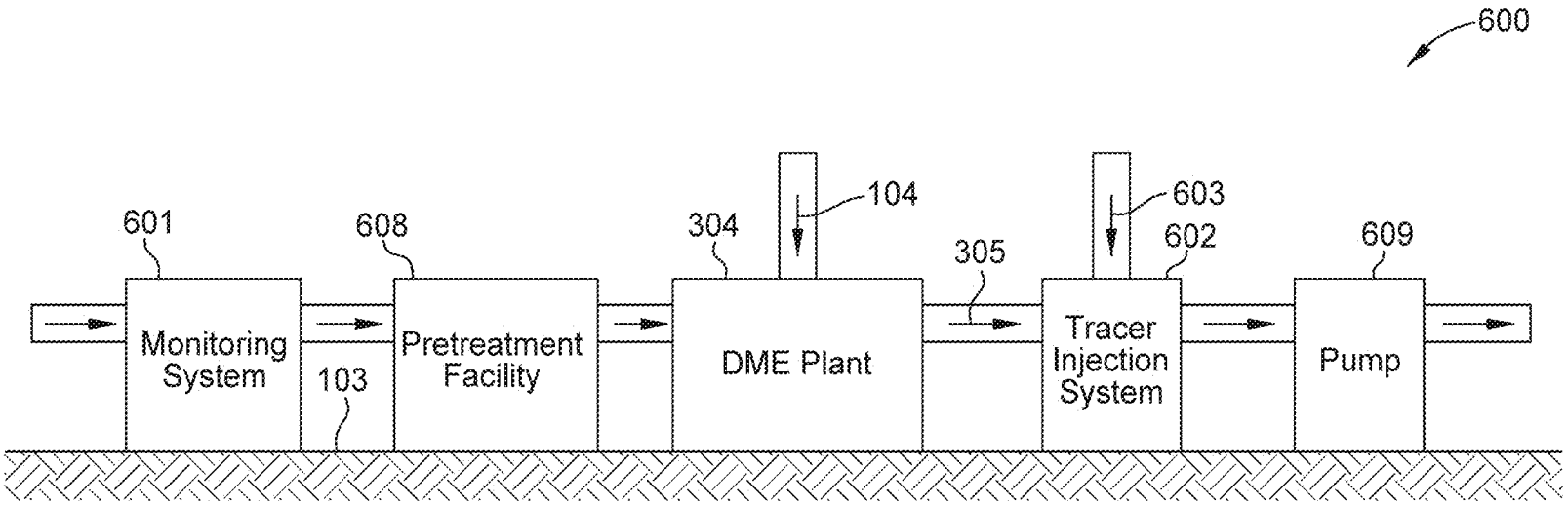
FIG. 5 illustrates the surface operations of a monitored DME process, according to one or more embodiments.

FIG. 5 illustrates the surface operations of a monitored DME process 600. This monitored process 600 includes the ability to detect and address breakthrough.

The monitored DME process 600 by drilling one or more extraction wells 301 and one or more injection wells 309 into one or more reservoir zones 101 including mineral brine 102 with desirable mineral product 104 suspended in it.

On the surface, the monitored DME process 600 is similar to DME processes 300, 400, 500 however, it includes a monitoring system 601 and a tracer injection system 602.

The tracer injection system 602 injects one or more tracers 603 into the depleted effluent 305 leaving the DME plant 304. In one or more embodiments, one tracer 603 is used. In one or more embodiments, multiple tracers 603 are used. In embodiments including multiple tracers 603, the tracers 603 may be of different types. In embodiments including multiple tracers 603, the tracers 603 may be of the same type. The one or more tracers 603 are detectable by sensors or processes. The one or more tracers 603 may be mixed into the depleted effluent 305 and/or injected into the depleted effluent 305 in slugs. The tracers 603 also may be injected continuously or may be modulated over time. The one or more tracers 603 may include, but are not limited to, isotopes, DNA, radioactive compounds, nano and/or micron-scale particles not typically present in reservoirs, and other molecular compounds. In some embodiments, a tracer 603 may include a depletion of or increase of an isotope already present in the mineral brine 102, such as increased levels of Lithium 6. As an example, the leading edge of depleted effluent 305 may be injected with increased levels of Lithium 6. In another example, the overall depleted effluent 305 content may be changed. Any number of isotopes may be used, but it is desirable that the isotopes are cost effective, available, and easy to separate. In some embodiments where the one or more reservoir zones 101 contain organisms, an optional tracer 603 may be a tag to the organism's DNA with abnormal isotope content, thus creating a native DNA tracer 603. This may be accomplished by raising the DNA in a nutrient fluid with the isotopes. DNA tracers 603 are particularly useful because they can be detected at extremely low concentrations and offer near-infinite numbers of individual codes. While there are many options for the one or more tracers 603, it is desirable that the one or more tracers 603 are cost-effective in significant volumes, are distinguishable from reservoir materials and other tracers, and are detectable by sensors or other processes at low concentrations The tracers 603 are used to track and monitor the depleted effluent 305 being injected into the one or more reservoir zones 101. Thus, if one of the one or more tracers 603 is detected in the extraction process (e.g. in the one or more extraction wells 301), operators can determine that depleted effluent 305 has broken through into the one or more extraction wells 301. As will be discussed in the descriptions of FIGS. 6A-6C, in some embodiments, multiple different tracers 603 may be used in the monitored DME processes 600, 700, 800, 900 to monitor and determine the source and/or location of the breakthrough.

Figure 6A:
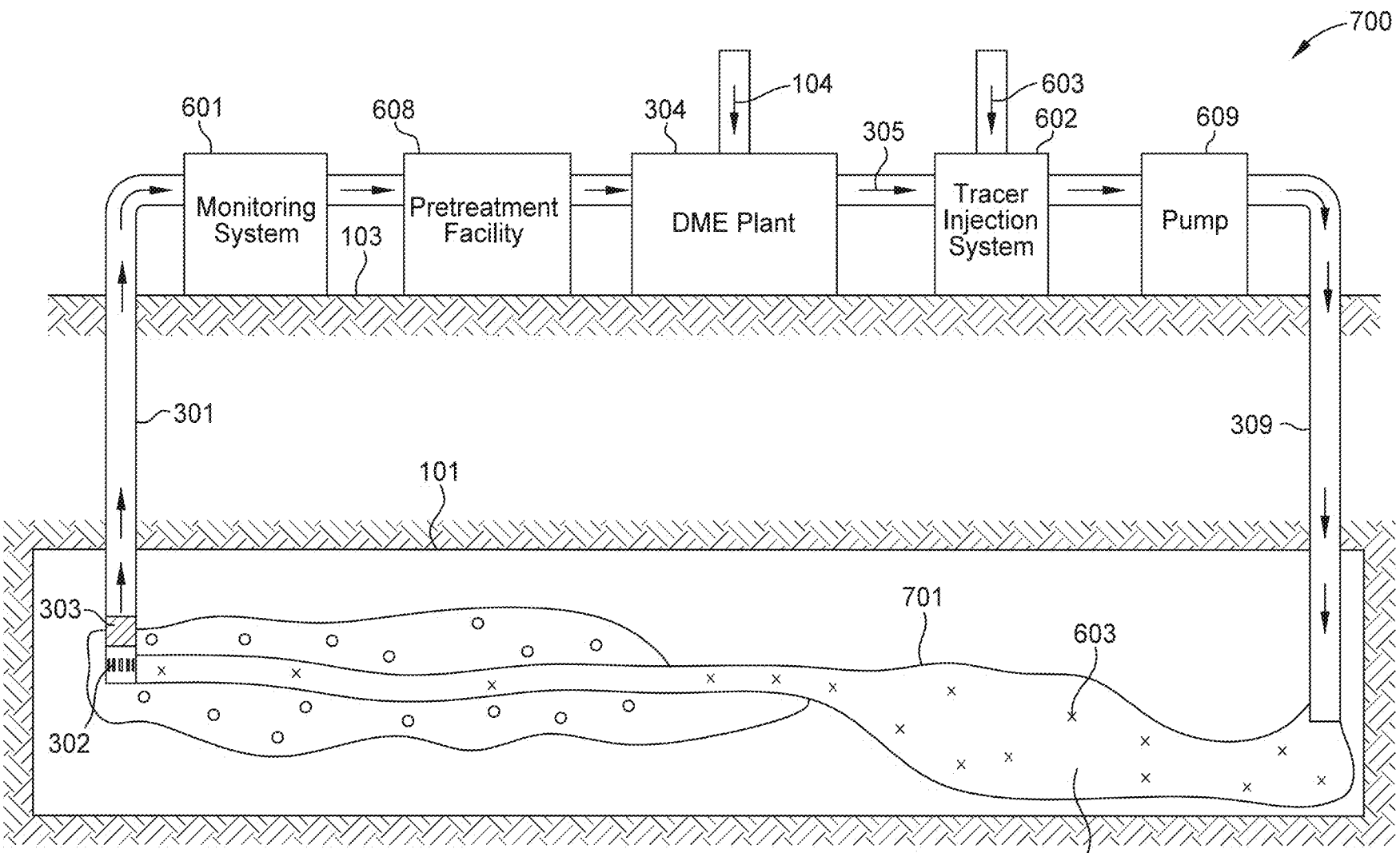
FIG. 6A illustrates another monitored DME process with a single reservoir zone, according to one or more embodiments.

In some embodiments, the tracer injection system 602 may inject the one or more tracers 603 into the depleted effluent 305 at the surface (as shown in FIG. 6A and discussed in the description of FIG. 6A).

Figure 6B:
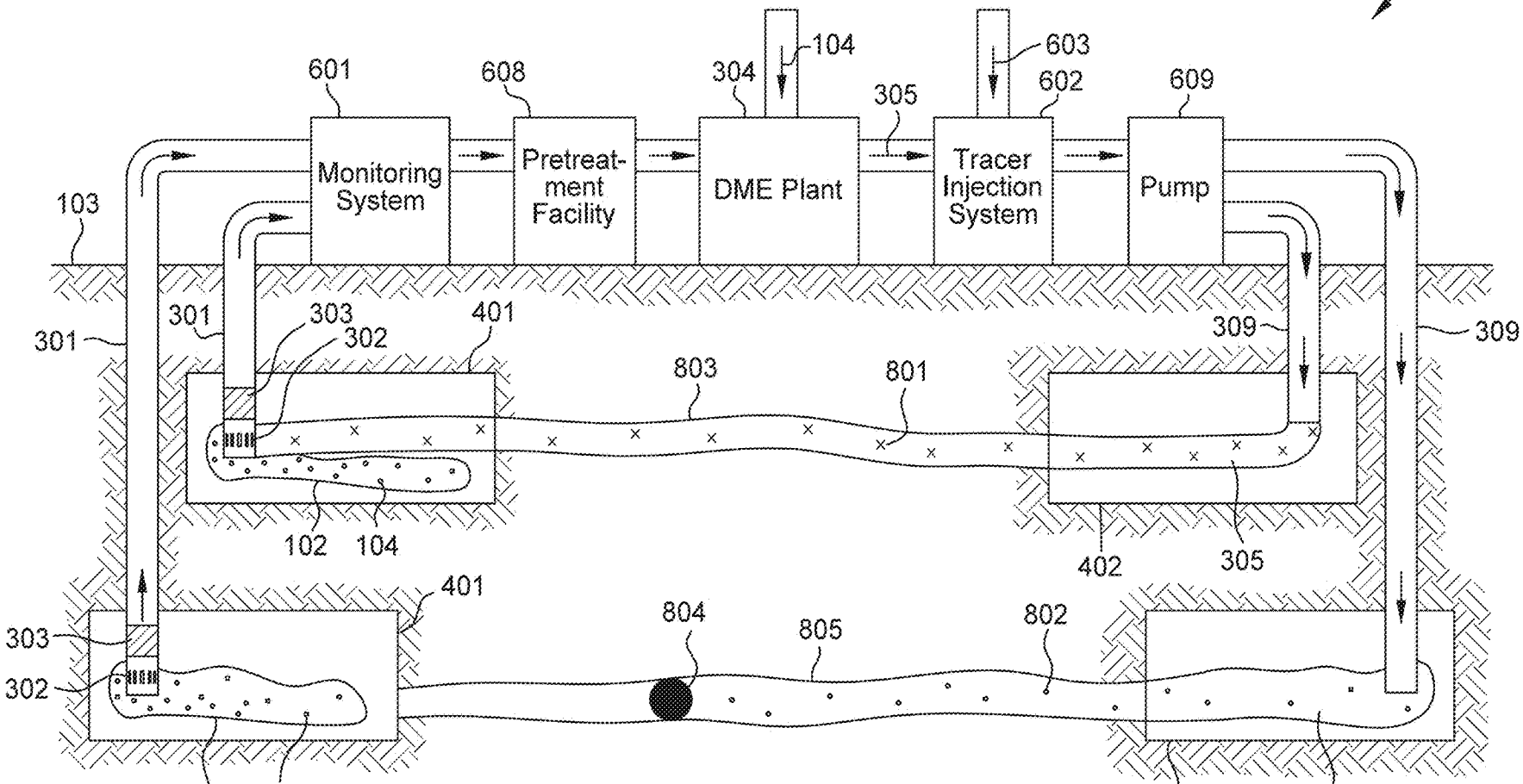
FIG. 6B illustrates another monitored DME process with multiple reservoir zones, according to one or more embodiments.
Figure 6C:
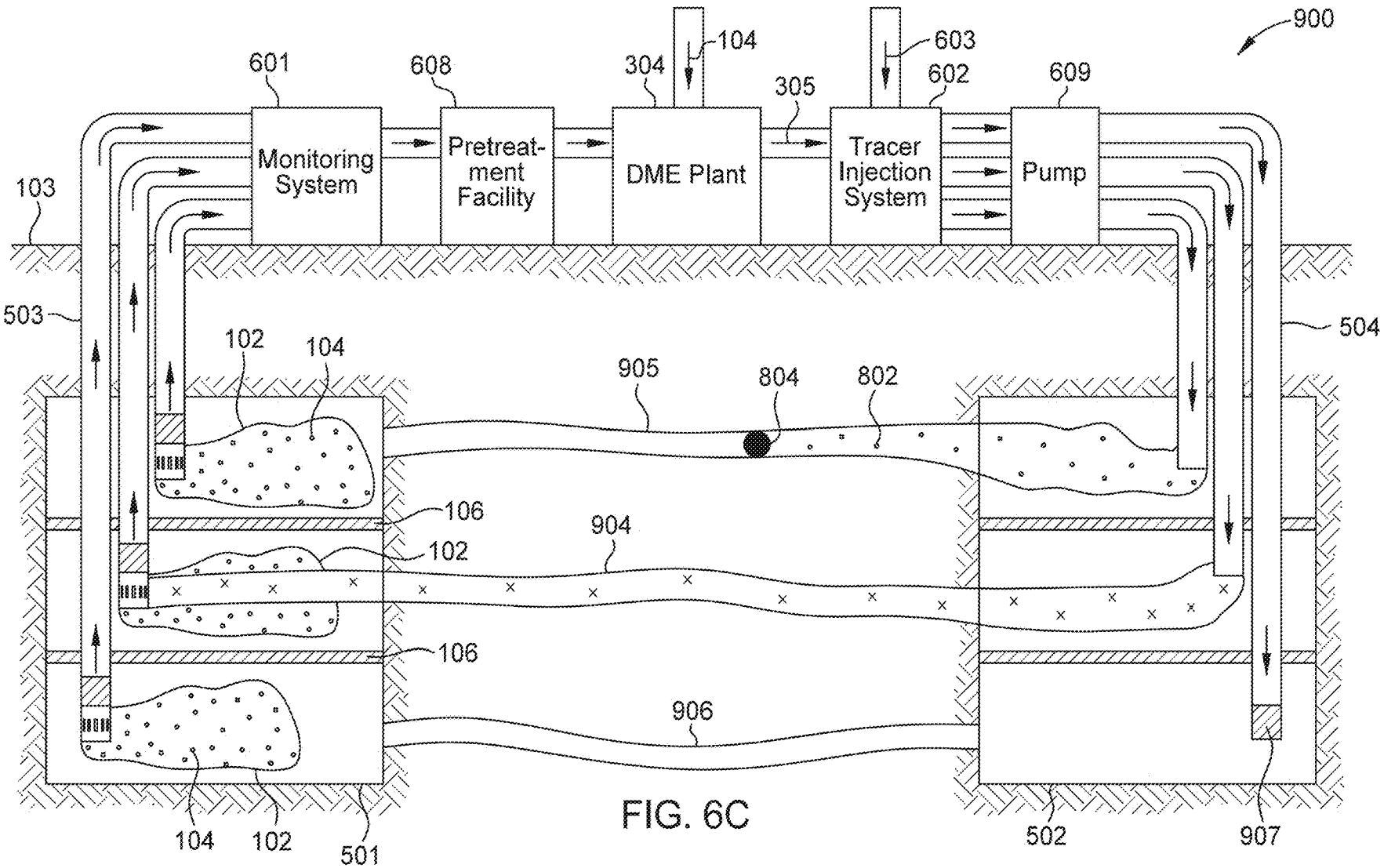
FIG. 6C illustrates another monitored DME process with multiple extraction depths, according to one or more embodiments.

In embodiments including multiple injection wells 309 (such as shown in FIG. 4B), the tracer injection system 602 may inject different tracers 603 directly into each of the injection wells 309 (as shown in FIG. 6C and discussed in the description of FIG. 6C).

Still, in other embodiments including a multi-depth injection well 504 (as shown in FIG. 4C), the tracer injection system 602 may inject different tracers 603 at each level of perforations 302 of the multi-depth injection well 504. The tracer injection system may be located downhole at a specific depth, close to the perforations, especially in cases where all of the level of perforations share a flow path.

In some embodiments, different tracers 603 may be used at different times in the monitored DME processes 600, 700, 800, 900. In such embodiments, the different tracers 603 may be detected in the extraction process and it may be determined when and at what stage of the monitored processes 600, 700, 800, 900 that the breakthrough is occurring. The injection of different tracers 603 at different times may also provide information as to the flow characteristics of the reservoir zone 101 over time by being able to differentiate flow fronts through the use of different tracers 603.

The monitoring system 601 monitors the fluid being extracted via the one or more extraction wells 301. As discussed previously, it is desirable to extract mineral brine 102, but if breakthrough occurs, depleted effluent 305 may also be extracted. The monitoring system 601 may include sensors or other processing devices. These sensors and/or processes are configured to detect the presence of, the identity of, and the amount of the one or more tracers 603. In embodiments where the tracers 603 include DNA tracers 603, a monitoring system 601 may detect the tracers 603 using DNA replication, nanodots, or chemicals. By detecting the presence of, identity of, and/or amount of the one or more tracers 603 in the fluid being extracted, it can be determined whether breakthrough has occurred into the one or more extraction wells 301 (e.g., if a tracer 603 is detected at extraction, depleted effluent 305 has broken through. Further, through the use of different tracers 603, it can also be determined where or when the breakthrough occurred. It can also be determined how much depleted effluent 305 has broken through based on how much tracer 603 is detected at extraction. As will be discussed in the description of FIGS. 6A-6C, in some embodiments, the monitoring system 601 may detect which of the injection reservoir zones 402, 502, extraction reservoir zones 401, 501, injection wells 309, 504, or extraction wells 301, 503, or any portions thereof, are responsible for the breakthrough.

In some embodiments, the monitoring system 601 may monitor the monitored DME processes 600, 700, 800, 900 as a whole for the presence of and identity of the one or more tracers 603 at the surface 103 (as shown in FIG. 6A and discussed in the description of FIG. 6A).

In embodiments including multiple extraction wells 301 (such as shown in FIG. 4B and FIG. 6B), the monitoring system 601 may monitor each extraction well 301 for the presence of or identity of the one or more tracers 603 (as shown in FIG. 6B and discussed in the description of FIG. 6B).

Still, in other embodiments including a multi-depth extraction well 503 (such as shown in FIG. 4C), the monitoring system 601 may monitor each layer of the multilayer reservoirs and/or each level of perforations 302 for the presence of or identity of the one or more tracers 603 (as shown in FIG. 6C and discussed in the description of FIG. 6C).

Thus, the surface operations of the monitored DME processes 600, 700, 800, 900 comprise the monitoring system 601, a pretreatment facility 608, a DME plant 304, the tracer injection system 602, and a pump 609. Each extraction well 301, 503 includes an ESP 303 for pumping fluid through perforations 302 to the surface 103. Fluid is monitored by the monitoring system 601 to detect the presence of, identity of, and amount of the one or more tracers 603.

Before the mineral product 104 is extracted from the mineral brine 102 at the DME plant 304, the mineral brine 102 may be pretreated at a pretreatment facility 608 before the sorption process. Pretreatment might involve injecting additives into the mineral brine, filtering the mineral brine, or processing the mineral brine 102 in another way to make the sorption process quicker, more efficient, or both. The pretreated mineral brine 102 is then pumped to the DME plant 304.

The DME plant 304 then extracts the desired mineral product 104 through sorption and sends the desired mineral product 104 for further processing and commercialization and pumps the depleted effluent 305 to the tracer injection system 602 and the pump 609 to be returned below the surface 103.

The tracer injection system 602 injects one or more tracers 603 into the depleted effluent 305 before or while the depleted effluent 305 is pumped below surface into the one or more reservoir zones 101, 402, 502 using the pump 609.

In some embodiments, the monitored DME process 600 further includes a control system. The control system is configured to control the operations of one or more of the monitoring system 601, the pretreatment facility 608, the DME plant 304, the tracer injection system 602, and/or the pump 609. The control system may include a controller with a processor, a memory, and a power supply. The processor may be configured to operate the various components of the monitored DME process 600 and accomplish various steps of methods for use thereof (such as method 1100 of FIG. 8). The memory may store instructions for the processor and may store settings and operation preferences. The power supply may supply power to the control system and may, in some instances, supply power to operate the DME process 600. In some embodiments, the control system operating the tracer injection system 602 manages both tracer 603 selection and concentrations when the monitoring system 601 has detected tracers 603. As an example, if the concentration of tracers 603 is significantly higher than the detection threshold, the injection concentration may be reduced to minimize tracer 603 cost.

FIG. 6A illustrates a monitored DME process 700 utilizing a single reservoir zone 101 similar to the DME process of FIG. 4A. Above surface 103, the operations consist of those shown in FIG. 5 and discussed in the description thereof. In sum, an ESP 303 pumps fluid comprising mineral brine 102 from a reservoir zone 101 into a monitoring system 601 to monitor for the presence of one or more tracers 603, the fluid is then pretreated at the pretreatment plant 608 for sorption at the DME plant 304, the desirable mineral 104 is extracted from the mineral brine 102 at the DME plant 304 and depleted effluent 305 leaves the DME plant 304, and the tracer injection system 602 injects one or more tracers 603 into the depleted effluent 305 before or while the depleted effluent 305 is pumped back down into the reservoir zone 101.

In some embodiments, the one or more tracers 603 may be removed from the mineral brine 102 during the DME process 700 after the one or more tracers 603 has been detected. The one or more tracers 603 may be removed from the mineral brine 102 so as to prevent reintroducing already detected tracers 603, which may lead to mixing of the tracers 603 and confusion in detection. In some embodiments, there is no need to remove the one or more tracers 603, because as soon as the one or more tracers 603 is detected, remedial action is taken.

FIG. 6A illustrates depleted effluent 305 breaking through at pathway 701 (i.e., the depleted effluent 305 comprising the tracer 603 is being extracted via extraction well 301). Accordingly, the monitoring system 601 would detect tracer 603 in the extracted depleted effluent 305 thus determining that breakthrough has occurred.

In some embodiments, multiple tracers 603 are used at different times in the lifespan of the monitored process 700 so that breakthrough can also be measured as a function of time and the flow front shape can be tracked. The injection of different tracers 603 at different times may also provide information as to the flow characteristics over time by having different flow fronts including different tracers 603.

A multitude of responses (e.g., "remedial actions") to breakthrough occurring may be employed in monitored DME process 700. In one or more embodiments, monitored process 700 can be halted. In one or more embodiments, extraction well 301 can be converted to an injection well 309 and a new extraction well 301 can be drilled thus abandoning the broken through extraction well. In one or more embodiments including a single reservoir zone 101 but multiple extraction wells 301 or injection wells 309, said extraction wells 301 or injection wells 309 may be selectively switched between extraction and injection, flowrates altered, may be selectively abandoned or plugged, and/or new extraction wells 301 and injection wells 309 can be drilled.

FIG. 6B illustrates another monitored DME process 800 utilizing multiple reservoir zones 101 similar to the process in FIG. 4B. Similar to FIG. 4B, the monitored process 800 includes at least one extraction reservoir zone 401 each with at least one of its own extraction wells 301 and at least one injection reservoir zone 402 each with at least one of its own injection wells 309. Otherwise, the monitored process 800 is similar to that described above in FIG. 6A. Above surface 103, the operations consist of those shown in FIG. 5 and discussed in the description thereof. In sum, the ESPs 303 pump fluid containing mineral brine 102 from one or more extraction reservoir zones 401 into a monitoring system 601 via one or more extraction wells 301 to monitor for the presence of one or more tracers 603, the fluid containing mineral brine 102 is then pretreated at pretreatment plant 608 for sorption at the DME plant 304, the desirable mineral 104 is extracted from the mineral brine 102 at the DME plant 304 and depleted effluent 305 leaves the DME plant 304, and a tracer injection system 602 injects one or more tracers 603 into the depleted effluent 305 before or while the depleted effluent 305 is pumped back into the one or more injection reservoir zones 402. Where the embodiment illustrated in 6B may differ is in where the one or more tracers 603 are injected and where the one or more extraction wells 301 are monitored.

In one or more embodiments including multiple injection reservoir zones 402 such as the one illustrated in FIG. 6B, it may be beneficial to inject different tracers 603 into different injection reservoir zones 402. As illustrated, the different tracers 603 include a first tracer 801 and a second tracer 802. Injection of multiple tracers 801,802 allows for tracking of where and how breakthrough is occurring. In one or more embodiments, the first tracer 801 may be injected into the depleted effluent 305 being injected into a first injection reservoir zone 402 and the second tracer 802 may be injected into the depleted effluent 305 being injected into a second injection reservoir zone 402. Thus, when the monitoring system 601 detects one of the tracers 801,802, it can be determined which injection reservoir zone 402 is breaking through.

Similarly, in one or more embodiments including multiple extraction reservoir zones 401, such as the one illustrated in FIG. 6B, it may be beneficial to monitor fluid being extracted out of each extraction reservoir zone 401. Thus, the monitoring system 601 can independently and individually monitor each extraction well 301. That way, if a tracer 801,802 is detected in one of the extraction wells 301 and not the other, breakthrough has occurred in the corresponding extraction reservoir zone 401 and not the other. Based on this information, remedial action can be taken.

FIG. 6B illustrates monitored DME process 800 in which depleted effluent 305 including the first tracer 801 has broken through from one injection reservoir zone 402 to one of the extraction reservoir zones 401 along pathway 803 and depleted effluent 305 including the second tracer 802 has broken through from one injection reservoir zone 402 to one of the extraction reservoir zones 401 along pathway 805. However, as illustrated, remedial action has been taken with respect to the second pathway 805 to stop breakthrough. As illustrated, the depleted effluent 305 including the first tracer 801 is still being extracted via one of the extraction wells 301. The monitoring system 601 then detects the first tracer 801 in the extracted depleted effluent 305 and determines that breakthrough has occurred and it occurred at a specific extraction well 301 in a specific extraction reservoir zone 401 from a specific injection reservoir zone 402.

As previously mentioned with respect to FIG. 6A, multiple tracers 603 may be used at different times in the lifespan of the monitored process 800 so that breakthrough can also be measured as a function of time. The injection of different tracers 603 at different times may also provide information as to the flow characteristics over time by having different flow fronts comprising different tracers 603.

A multitude of responses to breakthrough may be employed in monitored DME processes 800 with multiple reservoir zones 101, 401, 402. Similar to embodiments with one reservoir zone 101, the operation may be shut down. Also similar to embodiments with one reservoir zone 101, a broken through extraction well 301 could be converted to an injection well 309 and may or may not involve drilling more extraction wells 301 to support the monitored process 800.

However, when there are multiple reservoir zones 101 (such as extraction reservoir zones 401 and injection reservoir zones 402), multiple corresponding extraction wells 301, and multiple corresponding injection wells 309, there may be more options. In one or more embodiments, and as illustrated in the injection reservoir zone 402 and pathway 805 comprising the second tracer 802, an option may be to plug the pathway 805 in which breakthrough is occurring. This may be done by introducing gels, plugs, or patches to the injection reservoir zone 402 from which the breakthrough is occurring via the corresponding injection well 309. In the presently illustrated embodiment, a plug 804 has been used to block the breakthrough at pathway 805. In some embodiments, in response detection of the one or more tracers 603, the process may alter the chemistry or flow patterns of the injected depleted effluent 305.

In one or more embodiments, another option is to selectively shut down the broken through extraction well 301 or injection well 309 while continuing the process 800.

FIG. 6C illustrates another monitored DME process 900 utilizing multiple multi-layer reservoir zones 501, 502 similar to the process in FIG. 4C. Similar to FIG. 4C, the monitored process 900 includes at least one multi-layered extraction reservoir zone 501 each with at least one of its own multi-depth extraction well 503 and at least one injection reservoir zone 502 each with at least one of its own multi-depth injection well 504. Otherwise, the monitored process 900 is similar to that described above in FIG. 6A. Above surface 103, the operations consist of those shown in FIG. 5 and discussed in the description thereof. In sum, one or more ESPs 303 pumps fluid comprising mineral brine 102 from at least one multi-layered extraction reservoir zone 501 into a monitoring system 601 via one of the levels of the multi-depth extraction well 503, the fluid comprising mineral brine 102 is then pretreated at pretreatment plan 608 for sorption at the DME plant 304, the desirable mineral 104 is extracted at the DME plant 304 and depleted effluent 305 leaves the DME plant 304 and a tracer injection system 602 injects one or more tracers 603 into the depleted effluent 305 before or while the depleted effluent 305 is pumped into the different layers of the multi-layer injection reservoir zone 502. Where the embodiment illustrated in FIG. 6C differs from FIGS. 6A-B is in where the one or more tracers 603 are injected and where the one or more multi-depth extraction wells 503 are monitored.

In one or more embodiments including multi-layered reservoir zones 501, 502, such as the one illustrated in FIG. 6C, it may be beneficial to inject different tracers 603, here a first tracer 801, a second tracer 802, and a third tracer 903 at different levels of the multi-level injection wells 504. Injection of multiple different tracers 801, 802, and 903 allows for tracking of where and how the breakthrough is occurring. In embodiments such as the one illustrated in FIG. 6C the first tracer 801 may be injected into the depleted effluent 305 being pumped into one layer of the multi-layer injection reservoir zone 502, the second tracer 802 may be injected into the depleted effluent 305 being pumped into a second layer of the multi-layer injection reservoir zone 502, and the third tracer 903 may be injected into the depleted effluent 305 being pumped into a third layer of the multi-layer injection reservoir zone 502. Thus, when the monitoring system 601 detects one of the tracers 801, 802, 903, it can determine which layer of the multi-layer injection reservoir zone 502 is breaking through. Similarly, it may be beneficial to monitor the different levels of the multi-level extraction wells 503 to determine which layer of the multi-layered extraction reservoir zone 501 or level of the multi-leveled extraction well 503 is experiencing breakthrough.

FIG. 6C illustrates a monitored DME process 900 in which depleted effluent 305 including the first tracer 801 has broken through from one layer of the multi-layer injection reservoir zone 502 to one layer of the multi-layer extraction reservoir zone 501 along pathway 904, the depleted effluent 305 including the second tracer 802 has broken through from another layer of the multi-layer injection reservoir zone 502 into another layer of the multi-layer extraction reservoir zone 501 along pathway 905, and depleted effluent 305 comprising the third tracer 903 has broken through from a different layer of the multi-layer injection reservoir zone 502 into a different layer of the multi-layer extraction reservoir zone 501 along pathway 906, but a different remedial action has been taken to stop breakthrough. However, as illustrated, one type of remedial action has been taken to halt the breakthrough along pathway 905 and another type of remedial action has been taken to halt the breakthrough along pathway 906.

A multitude of responses to breakthrough may be employed in monitored DME processes 900 with multi-layered extraction reservoir zones 501 and multi-layered injection reservoir zones 502 such as the process 900 illustrated in FIG. 6C. Similar to the previously discussed embodiments, the operation may be shut down. Also similar to the previously discussed embodiments, another option may be to convert the broken through multi-depth extraction well 503 to a multi-depth injection well 504 and may or may not involve drilling more multi-depth extraction wells 503 to support the process. Similar to the embodiment discussed in FIG. 6B, other options include plugging the pathway in which breakthrough occurred and/or altering flow pattern chemistry. In the presently illustrated embodiment, pathway 905 comprising depleted effluent 305 with the second tracer 802 has been plugged with plug 804 to block breakthrough.

In embodiments including multi-layered extraction reservoir zones 501 with multi-depth extraction wells 503 and multi-layered injection reservoir zones 502 with multi-depth injection wells 504, there may be other options. As illustrated in the layer of the illustrated multi-layered injection reservoir zone 502 comprising the third tracer 903, another option is to selectively block, plug, or shut down a level of the multi-level injection well 504 where the depleted effluent 305 has broken through. Alternatively, the level of the multi-level extraction well 503 where the depleted effluent 305 has broken through may be selectively blocked, plugged, or shut down. Selectively blocking, plugging, or shutting down a level of a multi-level extraction well 503 or multi-level injection well 504 may be accomplished by selectively sending a blocking device 907 to a certain level of a multi-level extraction well 503 or multi-level injection well 504. In the presently illustrated embodiment, blocking device 907 has been deployed to the layer of the multi-layer injection well 504 comprising the third tracer 903 to stop breakthrough at pathway 906. In some embodiments, other methods of plugging a certain level may include mechanical valves that may be actuated hydraulically, electrically, or through use of an intervention tool such as coiled tubing, wireline, or slickline. In some embodiments, other methods of plugging a certain level may include introducing chemical plugs.

FIG. 7 partially illustrates another monitored DME process 1000. In monitored DME process 1000, rather than or additionally to monitoring the tracer(s) 603 at the surface or through a monitoring system (such as monitoring system 601), the monitoring is done in-situ. That is, in one or more embodiments, the monitoring of the tracers 603 is accomplished using a monitoring tool 1001.

Accordingly, the monitoring tool 1001 may be configured to monitor the tracers 603. For instance, the monitoring tool 1001 may be configured to monitor radioactive tracers 603. Accordingly, in one or more embodiments, the monitoring tool 1001 may be a gamma ray tool.

In one or more embodiments, monitoring the tracers 603 includes measuring the amount of tracers 603, determining the location of the tracers 603, and/or differentiating between different tracers 603. As an example, in embodiments of the process 1000 using multiple tracers 603, the monitoring tool 1001 can differentiate between the tracers 603 to determine when and/or where breakthrough is occurring.

The monitoring tool 1001 is installable in one or more of the wells and/or one or more reservoir zones of the operation. As illustrated, the monitoring tool 1001 is installed in a well 1004. As a non-limiting example, the monitoring tool 1001 may be installed in an extraction well (such as any of the previously described extraction wells 301, 503,). As another non-limiting example, and as illustrated, the monitoring tool 1001 may be installed in an injection well (such as any of the previously described injection wells 309, 504,). Still, in another non-limiting example, the monitoring tool 1001 is installable directly in the reservoir (such as any of the previously described reservoir zones 101, 107, 401, 402, 501, 502, 1003) or another subsurface feature (such as a finger 105 of FIG. 1).

As illustrated, the monitoring tool 1001 can be installed in a multi-depth well 1004 within a multilayer reservoir 1003.

The monitoring tool 1001 may also be moveable within the wells and/or reservoirs to log (e.g. map) flow characteristics of the process 1000 versus depth. As a non-limiting example, the monitoring tool 1001 moves within the subsurface of the process 1000 and detects, measures, and/or differentiates the tracer(s) 603 to map locations of breakthrough and flow fronts. For example, as shown in the illustrated embodiment, the monitoring tool 1001 is a downhole tool that may be lowered into or raised through one or more of the wells 1004 via a wireline 1002. Thus, in the presently illustrated embodiment, the monitoring tool 1001 can be raised or lowered through the well 1004 to monitor the tracers 603 at different depths and times. In one or more embodiments, this may be done to map tracers 603 for the purposes of mapping breakthrough across multiple levels of the multilayer reservoir 1003 or for the purposes of determining flow characteristics of the process 1000. For example, the embodiment illustrated shows the monitoring tool 1001 monitoring tracers 603 being injected into a multilayer reservoir 1003 which may be used to determine the flow characteristics of the injection well 1004 (e.g., the distribution of tracers 603 being injected at each level of the multilayer reservoir 1003). In other words, the monitoring tool in combination with the tracers enables to establish a fluid profile of the injection well.

While only illustrated as one monitoring tool 1001 disposed in one well 1004 it is understood that any number of monitoring tools 1001 can be used simultaneously or sequentially in process 1000.

Figure 8:
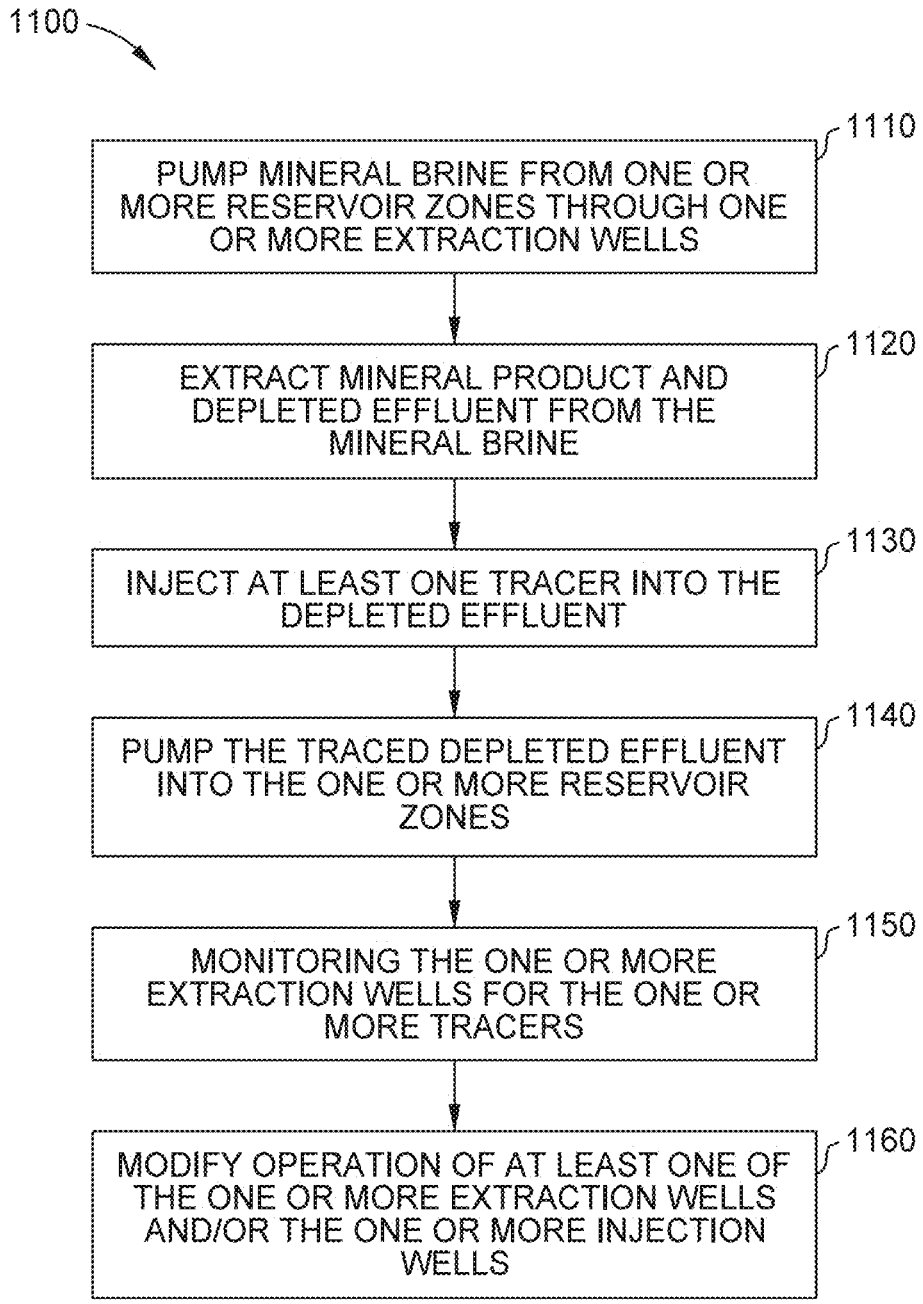
FIG. 8 illustrates one method for extracting minerals using the monitored DME process, according to one or more embodiments.

FIG. 8 illustrates a method 1100 for extracting minerals using a monitored DME process (such as monitored DME processes 700, 800, 900, 1000 of FIGS. 6A-6C and 7), according to one or more embodiments.

In step 1110 of the method 1100, fluid comprising mineral brine (such as mineral brine 102 of FIG. 1) is pumped from one or more reservoir zones (such as reservoir zones 101, 401, 402, 501, 502, and 1003 of FIGS. 6A-6C and 7) through one or more extraction wells (such as one or more extraction wells 301, 503 of FIGS. 6A-6C). The one or more reservoir zones may be single layer or multi-layered.

In step 1120, mineral product (such as mineral product 104) is extracted from the mineral brine. The mineral product may be extracted through sorption at a DME plant (such as DME plant 304 of FIGS. 6A-6C). After extraction, the DME plant produces depleted effluent (such as depleted effluent 305 of FIGS. 6A-6C and 7).

In some embodiments, before step 1120, the fluid comprising mineral brine may be pretreated at a pretreatment plant (such as pretreatment plant 608 FIGS. 5-6C) for improved desired mineral extraction at step 1120.

In step 1130, one or more tracers (such as one or more tracers 603, 801, 802, 903 of FIGS. 5-6C and 7) are injected into the depleted effluent leaving the DME plant and entering one or more injection wells (such as one or more injection wells 309, 504, and 1004 of FIGS. 6A-6C and 7). In some embodiments, the one or more tracers are injected at the surface, as shown in FIG. 6A. In some embodiments, the one or more tracers are injected in line with the one or more injection wells, such as shown in FIG. 6B. In some embodiments, the one or more tracers are injected at different levels of multi-level injection wells as shown in FIG. 6C. Different tracers may be injected at different places in the process and different tracers may be injected at different times in the method 1100 or process. The injection of different tracers at different times may also provide information as to the flow characteristics over time by having different flow fronts comprising different tracers that may be monitored and differentiated.

In step 1140, the depleted effluent comprising the one or more tracers is injected into one or more injection reservoir zones.

In step 1150, the one or more tracers are monitored. In one or more embodiments, any of the components or locations within the system may be monitored for the presence of, identity of, and/or amount of tracers. In one or more embodiments, the one or more extraction wells are monitored for the one or more tracers. Detection of one or more tracers at the one or more extraction wells is indicative of breakthrough. In some embodiments, the one or more extraction wells are monitored at the surface, as shown in FIG. 6A. In some embodiments, the one or more extraction wells are monitored in-line, as shown in FIG. 6B. In some embodiments, the one or more extraction wells are monitored at different levels of multi-level extraction wells as shown in FIG. 6C. Still, in one or more embodiments, the tracers are monitored in situ, as shown in FIG. 7.

In one or more embodiments, monitoring the one or more tracers includes using a monitoring tool (such as monitoring tool 1001 of FIG. 7) to monitor the one or more tracers. In such embodiments, the monitoring tool is installed (e.g., lowered into) one or more of the subsurface components of the DME process (e.g., one or more extraction wells, one or more injection wells, and/or one or more of the reservoirs). In one or more embodiments, the monitoring tool monitors, detects, and/or differentiates the one or more tracers so that the flow characteristics of the DME process can be mapped.

In step 1160, the monitored DME process is modified based on the monitoring step 1150. If one or more tracers are detected at the one or more extractions wells in step 1150, the monitored DME process is modified. Modification of the monitored DME process includes, but is not limited to, stopping the monitored DME process, shutting down one or more of the injection wells, shutting down one or more of the extraction wells, switching one or more of the extraction wells to one or more injection wells, drilling new extraction wells, drilling new injection wells, plugging one or more injection wells, plugging one or more extraction wells, plugging one or more pathways of breakthrough (such as pathways 306, 403, 505, 701, 803, 805, 904, 905, 906 of FIGS. 6A-6C), plugging or shutting down one or more depths of a multi-depth extraction well, and plugging or shutting down one or more depths of a multi-depth injection.

In some embodiments, the one or more tracers may also be removed from the mineral brine during the DME process after the one or more tracers has been detected. The one or more tracers may be removed from the mineral brine so as to prevent reintroducing already detected one or more tracers, which may lead to mixing of one or more tracers and confusion in detection. Whereas, in some embodiments, there is no need to remove the one or more tracers 603, because as soon as the one or more tracers 603 is detected, remedial action should be taken.

Example Aspects

Aspect 1: A method for extracting minerals from a reservoir zone comprising: extracting a fluid from the reservoir zone, the fluid comprising mineral brine and the mineral brine comprising the minerals; extracting the minerals from the mineral brine and producing a depleted effluent; injecting one or more tracers into the depleted effluent; injecting the depleted effluent with the one or more tracers into the reservoir zone; and monitoring the fluid for the one or more tracers.

Aspect 2: The method of Aspect 1, further comprising detecting the one or more tracers in the fluid.

Aspect 3: The method of Aspect 1-2, further comprising taking a remedial action.

Aspect 4: The method of Aspect 3, wherein the remedial action comprises stopping extraction of the fluid from the reservoir zone.

Aspect 5: The method of any of Aspects 1-4, wherein a first tracer is injected into a first portion of the depleted effluent and a second tracer is injected into a second portion of the depleted effluent, wherein the first tracer and second tracers are different.

Aspect 6: The method of any of Aspects 1-5, wherein extracting the minerals includes using a sorption medium selectively extracting the minerals from the fluid.

Aspect 7: The method of any of Aspects 1-6, wherein the fluid is extracted from the reservoir via one or more extraction wells, and wherein the depleted effluent with the one or more tracers is injected into the reservoir zone via one or more injection wells.

Aspect 8: The method of Aspect 7, wherein monitoring the fluid for the one or more tracers comprises using a downhole monitoring tool disposed in one or more of the one or more extraction wells, the one or more injection wells, and the reservoir zone.

Aspect 9: A method for extracting minerals from one or more extraction reservoir zones, comprising: extracting fluid from the one or more extraction reservoir zones, the fluid comprising mineral brine and the mineral brine comprising the minerals; extracting the minerals from the mineral brine and producing a depleted effluent; injecting one or more tracers into the depleted effluent; injecting the depleted effluent with the one or more tracers into one or more injection reservoir zones; and monitoring at least one of the one or more injection reservoir zones and the one or more extraction reservoir zones for the one or more tracers.

Aspect 10: The method of Aspect 9, further comprising: detecting the one or more tracers in the at least one of the one or more injection reservoir zones and the one or more extraction reservoir zones; and taking a remedial action.

Aspect 11: The method of Aspect 10, wherein the remedial action comprises stopping extraction of the fluid from the one or more extraction reservoir zones.

Aspect 12: The method of Aspect 10, wherein the remedial action comprises: converting the one or more extraction reservoir zones to one or more injection reservoir zones; and drilling a new one or more extraction reservoir zones.

Aspect 13: The method of any of Aspects 9-12, wherein: a first tracer is injected into a first portion of the depleted effluent and the first portion of the depleted effluent is injected into a first of the one or more injection reservoir zones; and a second tracer is injected into a second portion of the depleted effluent and the second portion of the depleted effluent is injected into a second of the one or more injection reservoir zones, wherein the first tracer is different from the second tracer.

Aspect 14: The method of Aspect 13, further comprising: detecting the first tracer in the one or more extraction reservoir zones; and determining that the first portion of the depleted effluent broke through from the first injection reservoir zone into the one or more extraction reservoir zones.

Aspect 15: The method of Aspect 14, further comprising taking the remedial action in response to determining that the first portion of the depleted effluent broke through from the first injection reservoir zone into the one or more extraction reservoir zones.

Aspect 16: The method of Aspect 15, wherein the remedial action comprises stopping injection into the first of the one or more injection reservoir zones.

Aspect 17: The method of Aspect 15 or 16, wherein the remedial action comprises injecting a plugging agent into the first portion of the depleted effluent.

Aspect 18: The method of any of Aspects 9-17, wherein monitoring the at least one of the one or more injection reservoir zones and the one or more extraction reservoir zones for the one or more tracers comprises: monitoring a first extraction reservoir zone of the one or more extraction reservoir zones; and monitoring a second extraction reservoir zone of the one or more extraction reservoir zones.

Aspect 19: The method of Aspect 18 further comprising: detecting one or more tracers in the first extraction reservoir zone; and determining that the depleted effluent broke through from the one or more injection reservoir zones into the first extraction reservoir zone.

Aspect 20: The method of Aspect 19, further comprising taking the remedial action in response to determining that the first portion of the depleted effluent broke through from the one or more injection reservoir zones into the first of the one or more extraction reservoir zones.

Aspect 21: The method of Aspect 20, wherein the remedial action comprises converting the first of the one or more extraction reservoir zones into one or more injection reservoir zones.

Aspect 22: The method of Aspect 20 or 21, wherein the remedial action comprises stopping extraction of the fluid from the first of the one or more extraction reservoir zones.

Aspect 23: The method of any of Aspects 9-22, wherein: at least one of the one or more injection reservoir zones is multi-layered; a first tracer is injected into a first portion of the depleted effluent and the first portion of the depleted effluent is injected into a first layer of the at least one multi-layered injection reservoir zone; and a second tracer is injected into a second portion of the depleted effluent and the second portion of the depleted effluent is injected into a second layer of the least one multi-layered injection reservoir zone, wherein the first tracer and the second tracer are different.

Aspect 24: The method of Aspect 23, further comprising: detecting the first tracer in the one or more extraction reservoir zones; and determining that the first portion of the depleted effluent broke through from the first layer of the least one multi-layered injection reservoir zone into the one or more extraction reservoir zones.

Aspect 25: The method of Aspect 24, further comprising taking the remedial action in response to determining that the first portion of the depleted effluent broke through from the first layer of the least one multi-layered injection reservoir zone into the one or more extraction reservoir zones.

Aspect 26: The method of Aspect 25, wherein the remedial action comprises plugging the first layer of the least one multi-layered injection reservoir zone.

Aspect 27: The method of Aspect 25 or 26, wherein the remedial action comprises injecting a plugging agent into the first portion of the depleted effluent.

Aspect 28: The method of any of Aspects 9-27, further comprising monitoring at least one of the one or more injection reservoir zones and the one or more extraction reservoir zones for the one or more tracers using a downhole monitoring tool.

Aspect 29: The method of Aspect 28, wherein monitoring includes logging at least one of the one or more injection reservoir zones and the one or more extraction reservoir zones using the downhole monitoring tool and determining a fluid distribution of the depleted effluent in the one or more injection reservoir zones and/or the extracted fluid in the one or more extraction reservoir zones Aspect 30: The method of Aspect 29, further comprising taking the remedial action in response to determining that the depleted effluent broke through from the one or more injection reservoir zones into the first layer of the at least one multi-layered extraction reservoir zone.

Aspect 31: The method of Aspect 30, wherein the remedial action comprises converting the at least one multi-layered extraction reservoir zone into one or more injection reservoir zones.

Aspect 32: The method of Aspect 30 or 13, wherein the remedial action comprises plugging the first layer of the at least one multi-layered extraction reservoir zone.

Aspect 33: A direct mineral extraction (DME) system, including a DME plant, a tracer injection system, and a monitoring system. The DME plant configured to selectively extract a mineral from a fluid comprising mineral brine and output a depleted effluent. The tracer injection system configured to inject one or more tracers into the depleted effluent. The monitoring system configured to detect the one or more tracers in the fluid.

Aspect 34: The system of Aspect 33, wherein the tracer injection system is configured to inject a first tracer into a first portion of the depleted effluent and a second tracer into a second portion of the depleted effluent, wherein the first tracer and the second tracer are different.

Aspect 35: The system of Aspect 33 or 34, further comprising: one or more extraction wells, wherein the one or more extraction wells are configured to supply fluid to the DME plant from a reservoir zone; and one or more injection wells, wherein the one or more injection wells are configured to inject the depleted effluent with the one or more tracers into the reservoir zone.

Aspect 36: The system of Aspect 33 to 35, wherein the monitoring system is configured to monitor the fluid supplied from the one or more extraction wells.

Aspect 37: The system of Aspect 33 to 36, further comprising: one or more extraction wells, wherein the one or more extraction wells are configured to supply the fluid to the DME plant from one or more extraction reservoir zones; and one or more injection wells are configured to inject the depleted effluent below the surface.

Aspect 38: The system of Aspect 37, wherein the tracer injection system is configured to inject a first tracer into a first portion of the depleted effluent that is injected by a first of the one or more injection wells.

Aspect 39: The system of Aspects 37 or 38, wherein the monitoring system is configured to monitor a first portion of the fluid supplied by a first of the one or more extraction wells.

Aspect 40: The system of Aspects 33 to 39, further comprising: at least one multi-depth extraction well, wherein the at least one multi-depth extraction well is configured to supply fluid to the DME from at least one multi-layered extraction reservoir zone; and at least one multi-depth injection well, wherein the at least one multi-depth injection well is configured to inject the depleted effluent into at least one multi-layered injection reservoir zone.

Aspect 41: The system of Aspect 40, wherein the tracer injection system is configured to inject a first tracer into a first portion of the depleted effluent that is injected by the at least one multi-depth injection well into a first layer of the at least one multi-layered injection reservoir zone.

Aspect 42: The system of Aspects 40 or 41, wherein the monitoring system is configured to monitor a first portion of the fluid supplied by the at least one multi-depth extraction well from a first layer of the at least one multi-layered extraction reservoir zone.

Aspect 43: The system of any of Aspects 33-42, wherein the DME plant uses a sorption medium to selectively extract the minerals from the fluid comprising mineral brine.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The present disclosure also contemplates that one or more aspects of the embodiments described herein may be substituted in for one or more of the other aspects described. The scope of the disclosure is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112 (f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A method for extracting minerals from a reservoir zone comprising:

extracting a fluid from an extraction area in the reservoir zone, the fluid comprising mineral brine and the mineral brine comprising the minerals;

extracting the minerals from the mineral brine and producing a depleted effluent;

injecting one or more tracers into the depleted effluent;

injecting the depleted effluent with the one or more tracers into an injection area of the reservoir zone;

monitoring the fluid for the one or more tracers;

detecting the one or more tracers in the extraction area;

determining the depleted effluent has broken through from the injection area into the extraction area based on the detection of the one or more tracers; and taking a remedial action to halt the breakthrough.

2. The method of claim 1, wherein a first tracer is injected into a first portion of the depleted effluent and a second tracer is injected into a second portion of the depleted effluent, wherein the first tracer and the second tracer are different.

3. The method of claim 1, wherein the remedial action includes converting the extraction area to an injection area and extracting the fluid from a second extraction area.

4. The method of claim 1, wherein the fluid is extracted from the reservoir zone via one or more extraction wells, and wherein the depleted effluent with the one or more tracers is injected into the reservoir zone via one or more injection wells.

5. The method of claim 4, wherein monitoring the fluid for the one or more tracers comprises using a downhole monitoring tool disposed in one or more of the one or more extraction wells, the one or more injection wells, or the reservoir zone.

6. The method of claim 5, further comprising:

lowering the downhole monitoring tool into the one or more of the one or more extraction wells, the one or more injection wells, or the reservoir zone; and moving the downhole monitoring tool into the one or more of the one or more extraction wells, the one or more injection wells, or the reservoir zone to map flow characteristics of the fluid.

7. A method for extracting minerals from one or more extraction reservoir zones, comprising:

extracting fluid from the one or more extraction reservoir zones, the fluid comprising mineral brine and the mineral brine comprising the minerals;

extracting the minerals from the mineral brine and producing a depleted effluent;

injecting one or more tracers into the depleted effluent;

injecting the depleted effluent with the one or more tracers into one or more injection reservoir zones;

monitoring at least one of the one or more injection reservoir zones or the one or more extraction reservoir zones for the one or more tracers;

detecting the one or more tracers in the one or more extraction reservoir zones;

determining the depleted effluent has broken through from the one or more injection reservior zones into the one or more extraction reservoir zones based on the detection of the one or more tracers in the one or more extraction reservoir zones; and taking a remedial action to halt the breakthrough.

8. The method of claim 7, wherein:

a first tracer is injected into a first portion of the depleted effluent and the first portion of the depleted effluent is injected into a first injection reservoir zone of the one or more injection reservoir zones; and a second tracer is injected into a second portion of the depleted effluent and the second portion of the depleted effluent is injected into a second injection reservoir zone of the one or more injection reservoir zones, wherein the first tracer is different from the second tracer.

9. The method of claim 8, wherein detecting the one or more tracers in the one or more extraction reservoir zones comprises detecting the first tracer in the one or more extraction reservoir zones, and wherein determining the depleted effluent has broken through from the one or more injection reservoir zones into the one or more extraction reservoir zones includes determining that the first portion of the depleted effluent broke through from the first injection reservoir zone into the one or more extraction reservoir zones.

10. The method of claim 9, wherein the remedial action includes injecting a plugging agent into the first injection reservoir zone via the first portion of the depleted effluent to halt the breakthrough.

11. The method of claim 7, wherein monitoring the at least one of the one or more injection reservoir zones and the one or more extraction reservoir zones for the one or more tracers comprises:

monitoring a first extraction reservoir zone of the one or more extraction reservoir zones; and monitoring a second extraction reservoir zone of the one or more extraction reservoir zones.

12. The method of claim 11, wherein the detecting the one or more tracers in the one or more extraction reservoir zones comprises detecting one or more tracers in the first extraction reservoir zone, and wherein determining the depleted effluent has broken through from the one or more injection reservoir zones into the one or more extraction reservoir zones includes determining that the depleted effluent has brrken through from the one or more injection reservoir zones into the first extraction reservoir zone.

13. The method of claim 7, wherein:

at least one of the one or more injection reservoir zones is multi-layered;

a first tracer is injected into a first portion of the depleted effluent and the first portion of the depleted effluent is injected into a first layer of the at least one multi-layered injection reservoir zone; and a second tracer is injected into a second portion of the depleted effluent and the second portion of the depleted effluent is injected into a second layer of the at least one multi-layered injection reservoir zone, wherein the first tracer and the second tracer are different.

14. The method of claim 13, wherein the detecting the one or more tracers in the one or more extraction reservoir zones comprises detecting the first tracer in the one or more extraction reservoir zones, and wherein determining the depleted effluent has broken through from the one or more injection reservoir zones into the one or more extraction reservoir zones includes determining that the first portion of the depleted effluent broke through from the first layer of the at least one multi-layered injection reservoir zone into the one or more extraction reservoir zones.

15. The method of claim 14, wherein the remedial action includes injecting a plugging agent into the first layer via the first portion of the depleted effluent to halt the breakthrough.

16. The method of claim 7, wherein monitoring the at least one of the one or more injection reservoir zones or the one or more extraction reservoir zones for the one or more tracers comprises using a downhole monitoring tool.

17. The method of claim 16, wherein tthe monitoring includes logging the at least one of the one or more injection reservoir zones or the one or more extraction reservoir zones using the downhole monitoring tool and determining a fluid distribution of the depleted effluent in the at least one of the one or more injection reservoir zones and the one or more extraction reservoir zones.

18. The method of claim 17, further comprising:

lowering the downhole monitoring tool into the at least one of the one or more injection reservoir zones or the one or more extraction reservoir zones; and moving the downhole monitoring tool to log the at least one of the one or more injection reservoir zones or the one or more extraction reservoir zones and determine the fluid distribution of the depleted effluent.

19. The method of claim 7, wherein the remedial action includes converting the one or more extraction reservoir zones into one or more injection reservoir zones and drilling another one or more extraction reservoir zones.

* * * * *